US005718291A

United States Patent [19]

Lorgen et al.

[11] Patent Number: 5,718,291

[45] Date of Patent: Feb. 17, 1998

[54] DOWNHOLE DISCONNECT TOOL

[75] Inventors: George M. Lorgen, Peterhead; Malcolm D. Pitman, Aberdeen; Alexander R. Crabtree, Newmachar, all of Scotland

[73] Assignee: Baker Hughes Incorporated, Houston, Tex.

[21] Appl. No.: 612,042

[22] Filed: Mar. 7, 1996

[51] Int. Cl.[6] ..... E21B 23/00

[52] U.S. Cl. ..... 166/377

[58] Field of Search ..... 160/377, 240, 160/319

[56] References Cited

U.S. PATENT DOCUMENTS

| | | | |
|---|---|---|---|
| 5,219,027 | 6/1993 | Taylor . | |
| 5,323,853 | 6/1994 | Leismer et al. | 166/377 X |
| 5,337,829 | 8/1994 | Taylor | 166/377 |
| 5,419,399 | 5/1995 | Smith | 166/377 |
| 5,526,888 | 6/1996 | Gazewood . | |

FOREIGN PATENT DOCUMENTS

WO95/33912 12/1995 WIPO .

*Primary Examiner*—William P. Neuder
*Attorney, Agent, or Firm*—Rosenblatt & Redano, P.C.

[57] ABSTRACT

A hydraulic disconnect is disclosed which allows flow therethrough for normal downhole operations. A shiftable sleeve is provided which closes off internal flow passages to permit pressure build-up which is in turn used to move a piston to undermine a dog to facilitate release. Shifting of a sleeve is accomplished by either creating backpressure through flow or by differential pressure between the inside of the joint and the annulus which is used to shift a piston which in turn acts on the release sleeve which in turn blocks a passage so that subsequent pressure build-up can result in shifting of another piston to undermine dogs which allows the joint to separate. The tool transmits torque through its body without stressing the locking dogs. Tensile and compressive loads are handled through the body giving the tool the connection strength of a tool joint.

28 Claims, 5 Drawing Sheets

DOWNHOLE DISCONNECT TOOL

FIELD OF THE INVENTION

The field of this invention relates to disconnect tools particularly those that are hydraulically actuated.

BACKGROUND OF THE INVENTION

There are many circumstances that require a disconnection downhole during drilling operations. When a portion of the bottomhole assembly becomes stuck the string needs to be pulled out and fishing or milling tool is inserted. In the past, disconnects have been used which have depended on dropping a ball to seal a flow passage to allow pressure build-up to facilitate the disconnection. However, in some operations wireline or other types of internal conduits may preclude the ability to be able to drop a ball and have it seat off to permit the pressure build-up required in prior disconnect tools for disconnection.

Fishing tools such as spears and overshots have been used which disconnect with applied pressure which releases collets which engage a fishing neck. Typical of such tools is U.S. Pat. No. 5,242,201. The fishing tool in the '201 patent releases on a predetermined flow therethrough. In some applications this may not be desirable. In other situations if flow through the tool is not possible it may not release.

The disconnect that has been developed prevents disconnection unless in a release position and it provides a backup way to put the sleeve in that position when flow through the sleeve is not possible.

Accordingly, the present invention has been developed to facilitate selective disconnection without the need for dropping a ball through the tubing. In the run in position the disconnect provides the capability of flowing therethrough. However, when a disconnection is needed it can be accomplished through the use of backpressure created by flowing through the connection or if the downhole equipment prevents flow through the connection an alternative is provided which allows use of built-up pressure to create the required movements to facilitate the disconnection. In either event balls or other obstructions need not be dropped from the surface to seat on a seat to facilitate the disconnection.

SUMMARY OF THE INVENTION

A hydraulic disconnect is disclosed which allows flow therethrough for normal downhole operations. A shiftable sleeve is provided which closes off internal flow passages to permit pressure build-up which is in turn used to move a piston to undermine a dog to facilitate release. Shifting of a sleeve is accomplished by either creating backpressure through flow or by differential pressure between the inside of the joint and the annulus which is used to shift a piston which in turn acts on the release sleeve which in turn blocks a passage so that subsequent pressure build-up can result in shifting of another piston to undermine dogs which allows the joint to separate. The tool transmits torque through its body without stressing the locking dogs. Tensile and compressive loads are handled through the body giving the tool the connection strength of a tool joint.

DETAILED DESCRIPTION OF THE PREFERRED EMBODIMENT

Figure 1B:
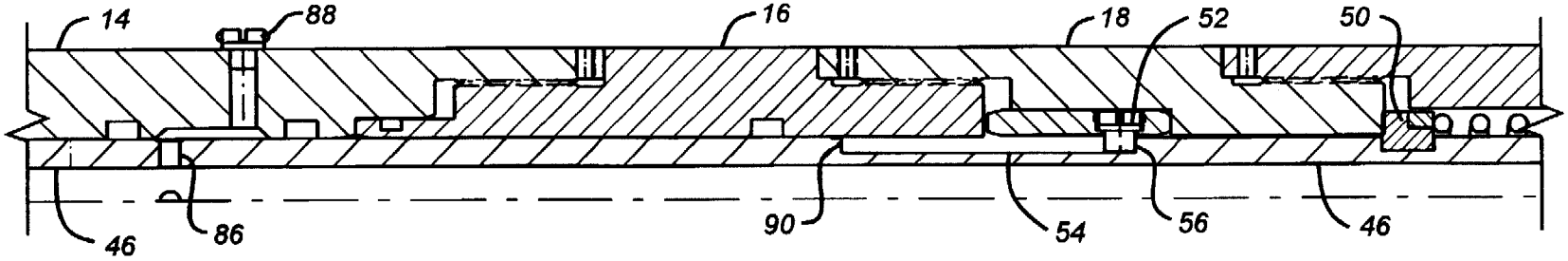
Figure 2B:
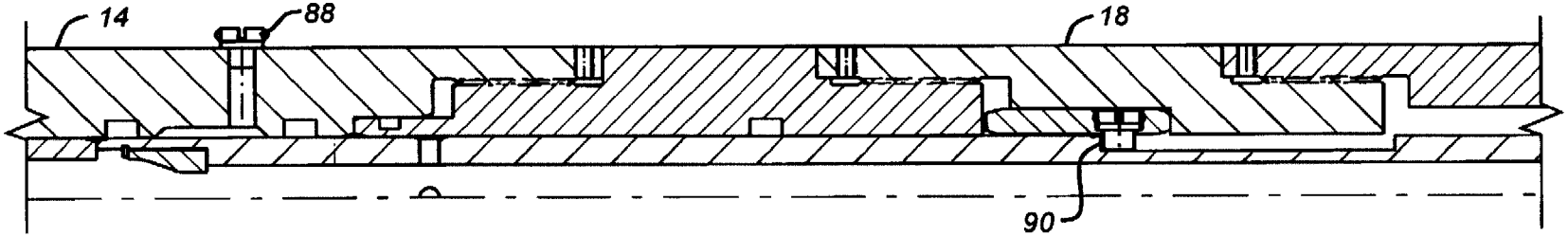
Figure 3B:
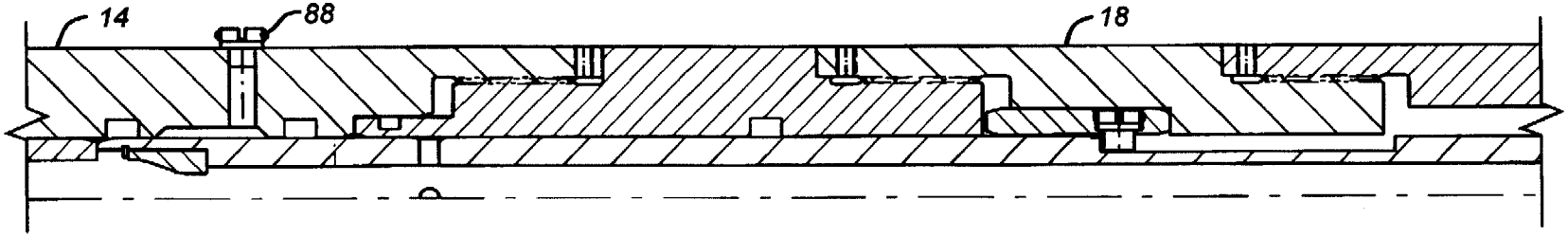
Figure 1C:
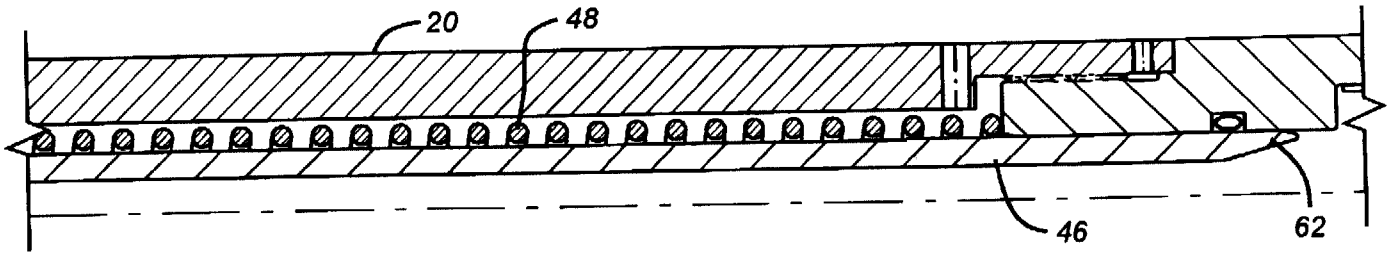
Figure 1D:
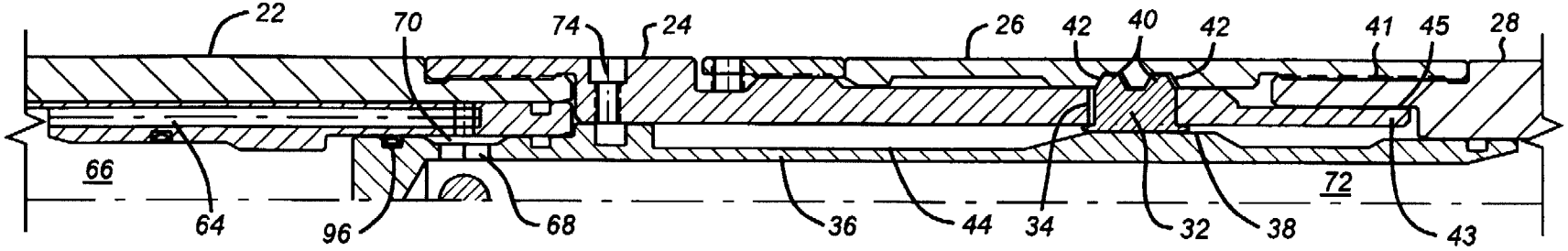
Figure 2D:
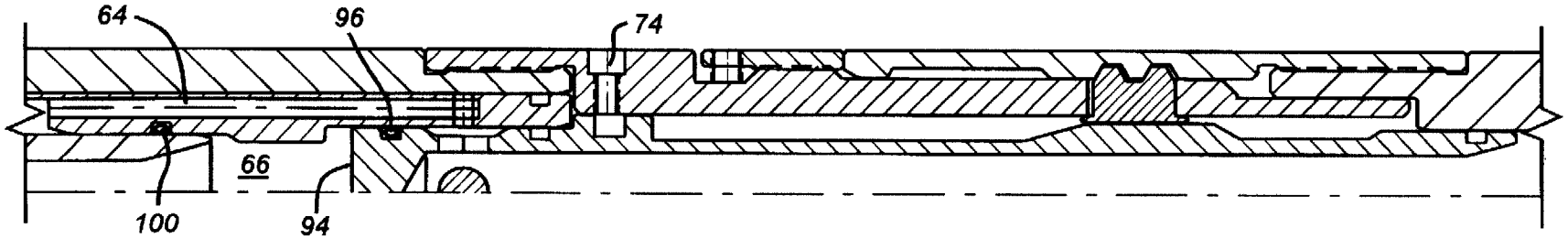

The apparatus is shown in the run in position in FIG. 1*a*–1*e*. It has a top sub 10 which can be connected to tubing, preferably coiled tubing (not shown) at thread 12. Top sub 10 is part of the outer body which is made up of a plurality of interconnected segments 14, 16, 18, 20, 22, 24, 26 and 28. The thread 30 is at the lower end of segment 28 to facilitate connection to the bottomhole assembly. The disconnection portion of the joint occurs between segments 24 and 26. As shown in FIG. 1*d* a dog or dogs 32 are inserted within an opening 34 in segment 24. A shiftable piston 36 has a raised surface 38 which supports the dogs 32 in the outward position where protrusions 40 extend into matching depressions 42 on segment 26. Accordingly, segment 24 is retained to segment 26 when the raised surface 38 urges the protrusions 40 outwardly into recesses 42. In the position shown in FIG. 1*d* longitudinal relative movement between the lower portion of the joint which comprises of segments 26 and 28 and the remainder of the outer assembly is prevented. As seen by comparing FIGS. 1*d* and 3*d*, ultimately the piston 36 is shifted causing the raised surface 38 to move away from the dogs 32 and juxtaposing surface 44 adjacent the dogs 32 which allows the dogs to retract away from segment 26 such that the protrusions 40 come out of recesses 42 sufficiently to allow separation between segments 24 and 26.

In the run in position shown in FIGS. 1*a*–1*e*, a shiftable sleeve 46 is biased by spring 48. Spring 48 bears on segment 22 at one end and against a ring 50 which is carried by sleeve 46 at the other end. Ring 50 creates an upward travel stop when it abuts segment 18 as shown in FIG. 1*b*. The sleeve 46 is movable with respect to the outer body assembly made up of segments 12–28, both longitudinally and rotationally, by virtue of an arrangement that is well known in the art and commonly referred to a J-slot assembly. The J-slot is seen in the section view of FIG. 1*b*. A pin 52 is secured to the outer body assembly, particularly segment 18. The series of successive slots are located on the sleeve 46 and represented schematically in the section in FIG. 1*b* as continuous slot 54. In a typical J-slot assembly, relative longitudinal movements cause the ramps in slots 54 to move along the pin 52 so that the relative longitudinal position between the sleeve 46 and the outer body assembly can be changed. A comparison of FIG. 1*b* with 2B illustrates that the sleeve 46 has shifted downwardly with respect to the outer body assembly. To get to this position it has also rotated. This movement of sleeve 46 can easily be seen by noting that the pin 52 in FIG. 1*b* is near the bottom 56 of a portion of the J-slot assembly 54. In this position the spring 48 can push on ring 50 to move sleeve 46 upwardly until ring 50 hits segment 18 precluding further travel. It should be noted that at the same time the upper end 58 also hits piston 60 which causes a further upward travel stop of the sleeve 46. Thus, in a normal run in position shown in FIG. 1*a*–1*e*, the spring 48 keeps the sleeve 46 in the position shown which in turn keeps the lower end 62 away from passage 64 as shown in FIG. 1*c* and 1*d*. Accordingly, a central flow path 66 is created which is in fluid communication with passage 64. Passage 64 ultimately communicates with passage or passages 68 through groove 70 and piston 36. Flow can continue from passages 68 through the piston 36 through an internal passage 72. Ultimately, flow is established through the entire apparatus and out the bottom segment 28 to the bottom hole assembly which is not shown.

The piston 36 is retained in position by shear pin or pins 74 which extend through segment 24 as shown in FIG. 1*d*.

Adjacent the upper end 58 of shiftable sleeve 46 is a restrictor 76 held by snap ring 78. Above the shiftable sleeve 46 is piston 60 which is sealed to top sub 10 by virtue of seal 80. Piston 60 is sealed against segment 14 by seal 81. Piston 60 communicates with the annulus through cavity 82 which in turn is in communication with passage or passages 84.

Passages 86 through the shiftable sleeve 46 are normally capped off by cap 88 such that flow directed through passage 66 communicates with passage 64 and then to groove 70 followed by passages 68 and finally through passage 72 and out through the bottom segment 28 to the bottom hole assembly. This occurs when the tool is in the flowing position shown in FIG. 1*a*–1*d*.

Figure 1A:
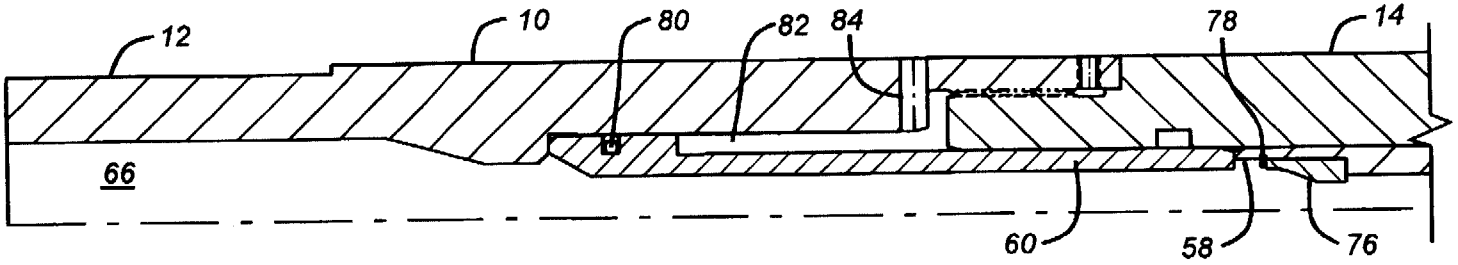
FIG. 1*a*–1*e* show the hydraulic disconnect in the run in position.
Figure 2A:
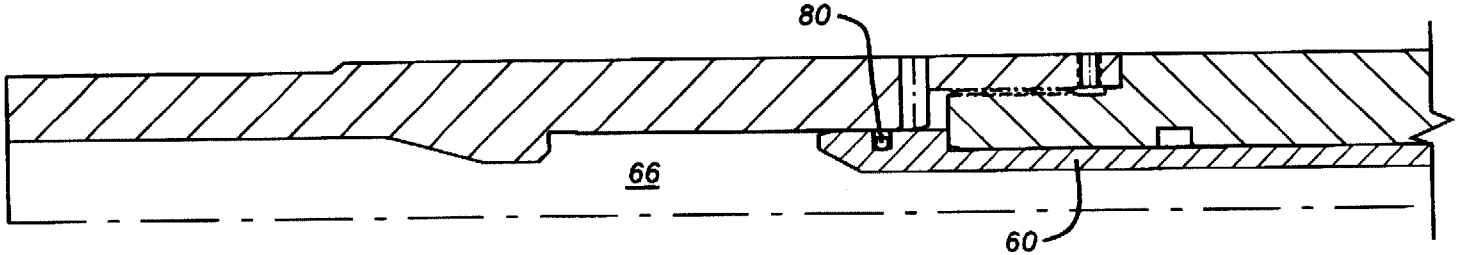
FIGS. 2*a*–2*e* show the hydraulic disconnect of FIG. 1*a*–1*e* shown in the plugged position prior to shearing off the pins on the support piston.
Figure 2C:
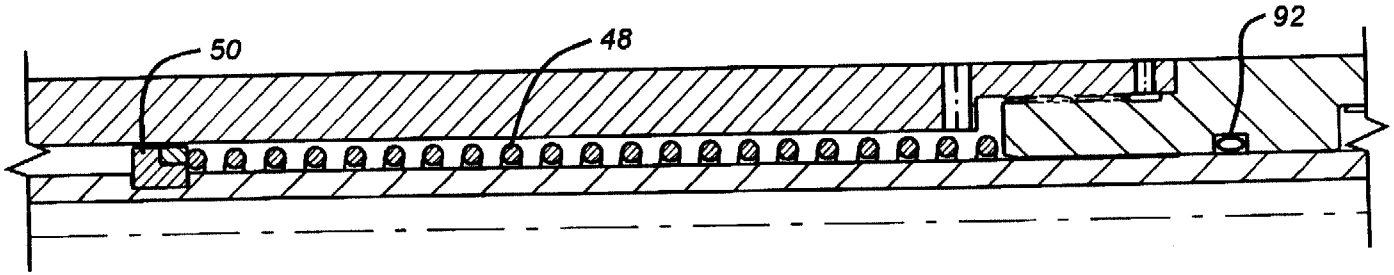
Figure 3C:
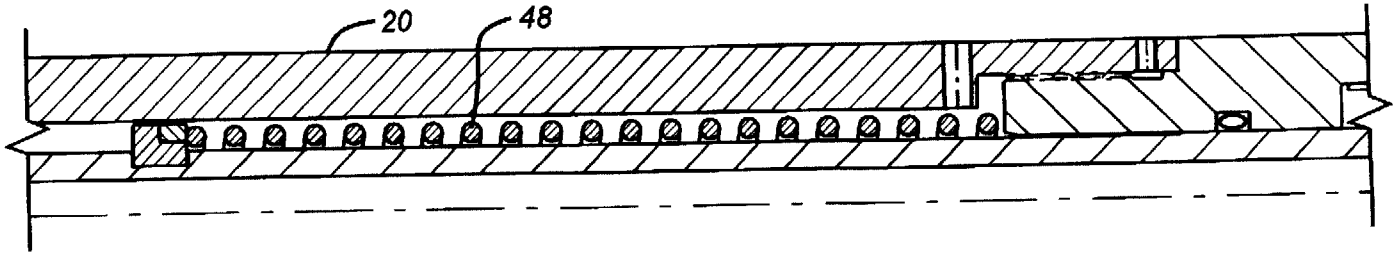

If it is desired to release the tool it can be done in two ways. If the bottom hole assembly permits flow through the apparatus, sufficient flow is passed through the restrictor 76 to create a backpressure above the upper end 58 of shiftable sleeve 46. Eventually sufficient backpressure is created through flow to urge the shiftable sleeve 46 to overcome the forces from spring 48. Depending upon layout of the J-slot assembly 54, the pressure is created and removed a sufficient number of times to allow the pin 52 to be aligned with the portion of the J-slot assembly that allows the upper end 90 of a portion of the J-slot assembly 54 to come adjacent the pin 52. At that point the shiftable sleeve 46 can go down sufficiently to seal off the passage 64 due to the presence of seals 92 and 100 as shown in FIG. 2*c*. At this point in time flow becomes interrupted and pressure can build above the top end 94 on piston 36 which seals off the passage 66 because of seal 96. Accordingly, with the apparatus shown in FIG. 2*a*–2*e* further pressure build-up with passage 64 obscured will break the shear pin or pins 74. When that occurs, the piston 36 can move downwardly thus moving the raised surface 38 away from dogs 32 which allows the dogs 32 to come back toward surface 44. At that point the segment 24 can be pulled away from segment 26 which in turn exposes the fishing neck 98 so that subsequent fishing operations can be used with a heavier work string than the coiled tubing which may have been previously secured to the outer body assembly at thread 12. Accordingly, one mode of disconnection has been fully described which involves flow which creates backpressure at restrictor 76. Through a series of applications of backpressure and subsequent shut downs of surface pumps, the pin 52 is ultimately aligned with a high portion at end 90 of the J-slot assembly 54 which allows the shifting sleeve 46 to come down sufficiently to obscure passage 64. It should also be noted that seal 100 in conjunction with seal 92 isolates the passage 64 from passage 66 to allow applied pressure in passage 66 to bear against the closed end 94 which is in turn sealed by seal 96. This pressure build-up is the motivating force to shift the piston 36 to undermine the dogs 32 for ultimate disconnection of the joint.

There also could occur conditions downhole where the bottomhole assembly does not permit flow through the apparatus. Since the restrictor 76 depends on flow therethrough to create a backpressure thereon for movement of the sleeve 46 in the J-slot assembly 54, it is clear that an obstruction in the bottomhole assembly renders the restrictor 76 ineffective. Accordingly, if that situation develops, an alternative way of actuation of sleeve 46 is provided. As previously described, piston 60 is exposed to passage 66 internally and externally through cavity 82 to annulus pressure through passage 84. Accordingly, even in a static situation where flow through the bottomhole assembly is not possible, pressure build-up can occur in passage 66 if the bottomhole assembly is plugged off. Upon sufficient pressure build-up the unbalanced forces on piston 60 are sufficient to overcome the forces of spring 48 and thus the sleeve 46 can selectively be moved through all the positions on the J-slot assembly 54. It should be noted that during drilling operations, there may be occasions to stop circulation at the surface. Accordingly, the J-slot assembly 54 can be provided with a plurality of positions in each of which the result is that flow is possible through passage 64. This allows the surface personnel to start the pumps and stop them several times without placing the J-slot assembly, and hence the sleeve 46, in a position where the passage 64 is obstructed and reapplication of pressure from the surface could result in shearing of pin 74 and an ultimate inadvertent release. Accordingly, the pressure value required to shear the pin 74 is set sufficiently high so that if for any reason the J-slot assembly 54 in conjunction with the pin 52 is in the position illustrated in FIG. 2*c* and 2*d* and disconnection is not desired, the surface personnel merely control the pressure to below the break point of shear pin 74 and then cut off the pumps. This allows the J-slot assembly 54 in connection with spring 48 to again rotate the shiftable sleeve 46 and get it out of the position where subsequent pressure build-ups will result in a disconnection.

Figure 3A:
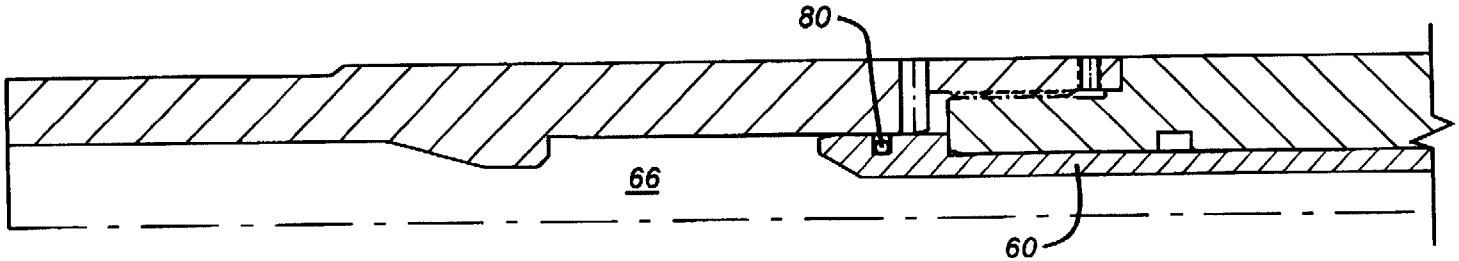
FIGS. 3*a*–3*e* is the hydraulic disconnect of FIGS. 2*a*–2*e* shown in the disconnected position with the locking dogs unsupported.
Figure 3D:
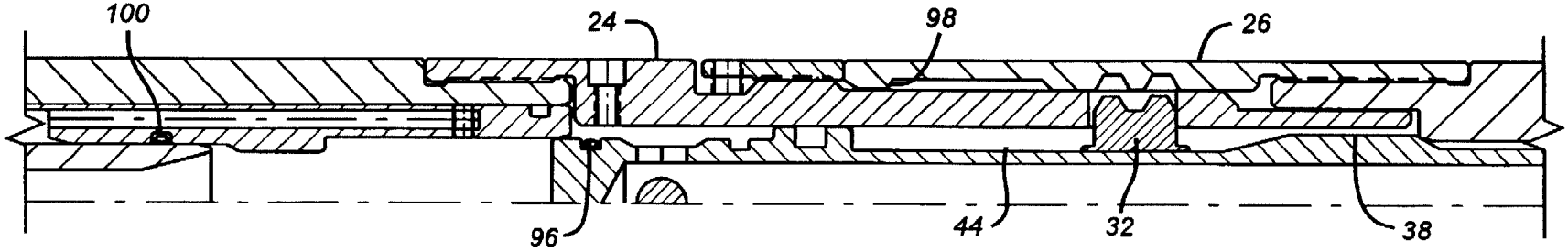
Figure 1E:
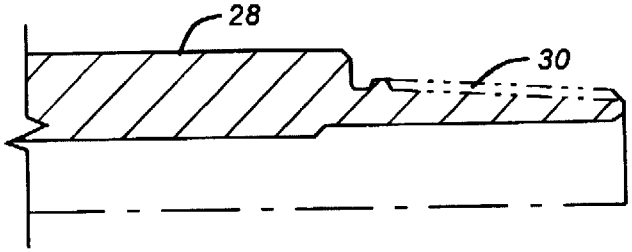
Figure 2E:
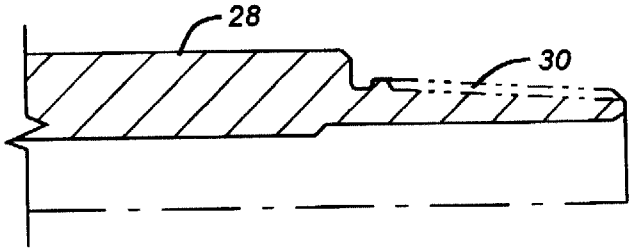
Figure 3E:
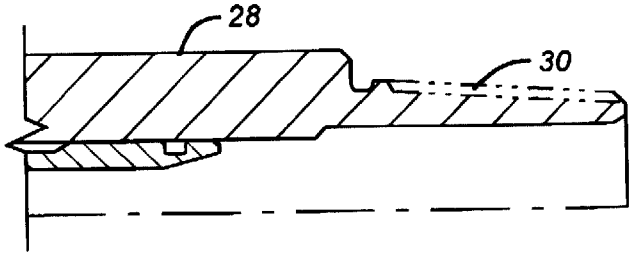

Those skilled in the art can now see that two different modes of disconnection of the hydraulic disconnect are seen from the description and the figures. In one mode of disconnection backpressure created by flow through restrictor 76 moves the sleeve 46 through the J-slot assembly 54 until the passage 64 is obstructed. Thereafter upon sufficient pressure build-up in passage 66 the piston 36 is forced to move when shear pin 74 breaks. As a result the dogs 32 become unsupported and segment 26 separates from segment 24 leaving the exposed fishing neck 98. On the other hand, if flow is not possible through the joint for disconnect, the piston 60 can be used to urge the shifting sleeve 46 to move against the force of spring 48 by contact at the upper end 58. If flow is used in conjunction with restrictor 76 to move the sleeve 46, the piston 60 merely moves in tandem with the downward movements of sleeve 46 as illustrated in FIGS. 2*a* and 3*a*. Ultimately, the sleeve 60 winds up in the same position (regardless of whether it is driven down or merely follows the movement of sleeve 46.

Those skilled in the art will appreciate that the above-described tool can be used in conjunction with coiled tubing when there are wireline, pneumatic, or hydraulic tubing or other obstructions running through the tubing which would prevent the obstruction of the passage in the tubing by means of advancing a ball or other shaped object through the coiled tubing and down toward the bottom hole assembly. A disconnect is disclosed which works hydraulically. Flow is one way to actuate the disconnect. Through the use of a J-slot assembly 54 sufficient cycles of flow, followed by discontinuation of flow, puts the sleeve 46 in the position to obstruct flow through passage 64. This is seen at the surface by a rapid pressure build-up because passage 66 is obstructed. If upon noticing this there is no desire to disconnect, then before reaching the pressure level at which the shear pin 74 will break the pumps at the surface are turned off again allowing the J-slot assembly 54 in connection with sleeve 46 to shift to another position with the aid of spring 48 so that when the pumps at the surface are turned on again, the passage 64 is exposed. With passage 64 exposed the pressure needed on top of top end 94 of piston 36 is not achieved to a sufficient level to break the shear pin 74. However, if disconnection is desired then pressure is built up with passage 64 obstructed, resulting in breaking of shear pin 74 and shifting of sleeve 36 to undermine dogs 32. If the bottom hole assembly does not permit flow therethrough sufficient pressure differential on piston 60 ultimately creates a net unbalanced force big enough to move piston 60 in tandem with sleeve 46 compressing spring 48 and the procedure for disconnection is repeated. Thus the tool disclosed gives signals to the surface personnel of the position of the J-slot assembly 54 to prevent inadvertent disconnections. It also gives surface personnel alternative means of actuating the joint as well as exposing a fishing neck 98 after the joint has separated and the upper portions which includes all the segments from 12 through 24 removed from the wellbore. At this point a more rigid work string can be lowered to fish for the bottomhole assembly using fishing neck 98 or for milling if fishing proves unsuccessful.

The tool has the strength of a tool joint in torsion, tension or compression which is an improvement over collet or shear designs which have limitations in one or more of these areas. With regard to torque transmission, segment 24 has a hex lower end 43 which fits into a mating receptacle 45 as shown in FIG. 1*d*. Thread 41 holds segments 26 and 28 together against tension or compression along with dogs 32. Torque can be transmitted from top sub 10 to bottom sub 28 without transmission of such torque through dogs 32 or shifting sleeve 36.

The foregoing disclosure and description of the invention are illustrative and explanatory thereof, and various changes in the size, shape and materials, as well as in the details of the illustrated construction, may be made without departing from the spirit of the invention.

We claim:

1. A downhole disconnection tool operable from the surface of a wellbore comprising:

a body made of at least two separable segments and defining a flowpath therethrough;

a locking assembly to selectively hold said segments together;

a release assembly operable in said flowpath and actuable from the surface into a release position, whereupon movement into the release position defeats said locking assembly, said release assembly, when not in the release position, precludes defeat of said locking assembly responsive to flow or applied pressure in said flowpath, a subsequent pressure buildup in said flowpath of a predetermined amount, with said release assembly in the release position, overcomes said locking assembly and allows said segments to separate.

2. A downhole disconnection tool operable from the surface of a wellbore comprising:

a body made of at least two separable segments and defining a flowpath therethrough;

a locking assembly to selectively hold said segments together;

a release assembly operable in said flowpath to defeat said locking assembly, said release assembly not affecting defeat of said locking assembly responsive to flow or applied pressure in said flowpath unless first selectively placed in a release position from the surface followed by pressure buildup in said flowpath of a predetermined amount; and said release assembly is manipulated into said release position from the surface via selective application and withdrawal of applied pressure in said flowpath.

3. The tool of claim 2 wherein:

said release assembly comprises a sleeve movable with respect to said body; and said applied pressure on said sleeve is created from flow through said flowpath.

4. The tool of claim 2 wherein:

said release mechanism is additionally manipulatable from the surface into said release position by application pressure in said flowpath, without flow, in situations where said flowpath is for any reason obstructed.

5. The tool of claim 2 wherein:

said release assembly comprises a sleeve movable with respect to said body;

said locking assembly comprises a locking piston which obstructs said flowpath;

said body defining a bypass passage to allow flow from said flowpath to selectively bypass said locking piston when said bypass passage is unobstructed.

6. The tool of claim 5 wherein:

said sleeve is movable between a first position where it does not obstruct said bypass passage and a second or said release position where said bypass passage is obstructed by said sleeve;

said locking piston having a passage therethrough in flow communication with said bypass passage to allow said locking piston to obstruct the flowpath at its top end but at the same time to selectively provide fluid from said flowpath to flow through said locking piston if said sleeve does not obstruct said bypass passage.

7. The tool of claim 6 wherein:

said locking piston is selectively retained to said body until a predetermined force in said flowpath with said bypass passage isolated from said flowpath is applied on said locking piston;

said locking piston supporting at least one dog that holds said body segments together until said predetermined force causes said locking piston to move to undermine support for said dog.

8. The tool of claim 2 wherein:

said release assembly comprises a biased sleeve movably retained by said body by a lug movable in a continuing groove;

said sleeve having a restrictor thereon whereupon flow through said restrictor creates an applied force on said sleeve which overcomes said bias and advances said groove with respect to said lug to selectively place said sleeve in said release position.

9. The tool of claim 8 further comprising:

a pressure piston mounted adjacent said sleeve and exposed to said flowpath on one side and to outside said body on an opposite side;

whereupon if flow through said restrictor is not possible for creation of an applied force, said sleeve can be moved against said bias by said pressure piston by elevation of pressure in said flowpath to a predetermined amount.

10. The tool of claim 8 wherein:

said continuing groove advances with respect to said lug responsive to application and removal of said applied force to shift said sleeve between a first position and said release position;

said locking assembly comprises a locking piston which obstructs said flowpath;

said body defining a bypass passage to allow flow from said flowpath to bypass said locking piston when said bypass passage is unobstructed.

11. The tool of claim 10 wherein:

said sleeve is movable between a first position where it does not obstruct said bypass passage and a second or said release position where said bypass passage is obstructed by said sleeve;

said locking piston having a passage therethrough in flow communication with said bypass passage to allow said locking piston to obstruct the flowpath at its top end but at the same time to selectively provide fluid from said flowpath to flow through said locking piston if said sleeve does not obstruct said bypass passage.

12. The tool of claim 11 wherein:

said locking piston retained to said body by at least one shear pin, said shear pin requires a higher force to break than is required to overcome said bias on said sleeve;

whereupon, if said sleeve is in said release position, separation of said segments can still be avoided by reducing the pressure in said flowpath prior to breaking said shear pin whereupon said bias advances said continuing groove with respect to said lug to allow said sleeve to return to its said first position.

13. The tool of claim 12 wherein:

said continuous groove is configured so that in at least one position said sleeve cannot be moved sufficiently to obstruct said bypass passage thus preventing subsequent separation from applied pressure or flow through said flowpath.

14. The tool of claim 10 wherein:

said sleeve turns and translates responsive to selective application and removal of force thereon with the result being that said continuous groove advances with respect to said lug for selective obstruction of said bypass passage.

15. The tool of claim 4 wherein:

said release assembly comprises a sleeve movable with respect to said body;

said locking assembly comprises a locking piston which obstructs said flowpath;

said body defining a bypass passage to allow flow from said flowpath to bypass said locking piston when said bypass passage is unobstructed.

16. The tool of claim 15 wherein:

said sleeve is movable between a first position where it does not obstruct said bypass passage and a second or said release position where said bypass passage is obstructed by said sleeve;

said locking piston having a passage therethrough in flow communication with said bypass passage to allow said locking piston to obstruct the flowpath at its top end but at the same time to selectively provide fluid from said flowpath to flow through said locking piston if said sleeve does not obstruct said bypass passage.

17. The tool of claim 16 wherein:

said locking piston is selectively retained to said body until a predetermined force in said flowpath with said bypass passage isolated from said flowpath is applied on said locking piston;

said locking piston supporting at least one dog that holds said body segments together until said predetermined force causes said locking piston to move to undermine support for said dog.

18. The tool of claim 17 wherein:

said applied pressure on said sleeve is created from flow through said flowpath.

19. The tool of claim 18 wherein:

said release assembly comprises a biased sleeve movably retained by said body by a lug movable in a continuing groove;

said sleeve having a restrictor thereon whereupon flow through said restrictor creates an applied force on said sleeve which overcomes said bias and advances said groove with respect to said lug to selectively place said sleeve in said release position.

20. The tool of claim 19 further comprising:

a pressure piston mounted adjacent said sleeve and exposed to said flowpath on one side and to outside said body on an opposite side;

whereupon if flow through said restrictor is not possible for creation of an applied force, said sleeve can be moved against said bias by said pressure piston by elevation of pressure in said flowpath to a predetermined amount.

21. The tool of claim 20 wherein:

said continuing groove advances with respect to said lug responsive to application and removal of said applied force to shift said sleeve between a first position and said release position.

22. The tool of claim 21 wherein:

said locking piston retained to said body by at least one shear pin, said shear pin requires a higher force to break than is required to overcome said bias on said sleeve;

whereupon, if said sleeve is in said release position, separation of said segments can still be avoided by reducing the pressure in said flowpath prior to breaking said shear pin whereupon said bias advances said continuing groove with respect to said lug to allow said sleeve to return to its said first position.

23. The tool of claim 21 wherein:

said continuous groove is configured so that in at least one position said sleeve cannot be moved sufficiently to obstruct said bypass passage thus preventing subsequent separation from applied pressure or flow through said flowpath.

24. The tool of claim 21 wherein:

said sleeve turns and translates responsive to selective application and removal of force thereon with the result being that said continuous groove advances with respect to said lug for selective obstruction of said bypass passage.

25. The tool of claim 2 wherein:

said release assembly is movable into said release position without dropping an object into said body from the surface.

26. The tool of claim 2 wherein:

said body has an upper and a lower end whereupon torque input at one end is transferred to the other end without transference of said torque through said locking assembly.

27. The tool of claim 5 wherein:

said body has an upper and a lower end whereupon torque input at one end is transferred to the other end without transference of said torque through said locking assembly.

28. The tool of claim 15 wherein:

said body has an upper and a lower end whereupon torque input at one end is transferred to the other end without transference of said torque through said locking assembly.

* * * * *